United States Patent [19]

Taya

[11] Patent Number: 4,947,041

[45] Date of Patent: Aug. 7, 1990

[54] ANALYZER TUBE FOR MASS SPECTROMETRY

[75] Inventor: Shunroku Taya, Mito, Japan

[73] Assignee: Hitachi, Ltd., Tokyo, Japan

[21] Appl. No.: 195,809

[22] Filed: May 19, 1988

[30] Foreign Application Priority Data

May 25, 1987 [JP] Japan ..... 62-127792

[51] Int. Cl.[5] ..... H01J 49/30

[52] U.S. Cl. ..... 250/298; 250/281; 335/210

[58] Field of Search ..... 250/298, 294, 281; 335/210

[56] References Cited

U.S. PATENT DOCUMENTS 3,699,332 10/1972 Hull et al. ..... 250/298

4,560,879 12/1985 Wu et al. ..... 250/281

FOREIGN PATENT DOCUMENTS 56-13706 2/1981 Japan ..... 335/210

58-204463 11/1983 Japan ..... 250/298

*Primary Examiner*—Jack I. Berman

*Attorney, Agent, or Firm*—Antonelli, Terry, Stout & Kraus

[57] ABSTRACT

An analyzer tube for mass spectrometry comprises a body tube having a central axis, a part of which extends along an arc, and a pair of magnetic poles, each provided on the respective window formed in a side wall of the body tube. One end portion of the magnetic pole projects into an interior of the body tube. The projecting end portion is so tapered that a cross sectional shape along any direction perpendicular to the central axis presents an inverted trapezoid. Ridges extending parallel to the central axis are provided in opposite sides of the projecting end portion of the magnetic pole. A pair of baffle plates are disposed adjacent to opposite inner side wall surfaces. The baffle plate has an angled cross sectional shape and is so disposed in the analyzer tube that ridge of the baffle plate projects inwardly and extends parallel to the central axis.

4 Claims, 5 Drawing Sheets

ANALYZER TUBE FOR MASS SPECTROMETRY

FIELD OF THE INVENTION AND RELATED ART STATEMENT

The present invention relates to an analyzer tube for mass spectrometry, which is suitable, for example, to the mass spectroscope using electromagnets or the mass fractionater for ion beam processing.

In the prior art analyzer tube 1, a tube 10 is interposed between magnet poles 20, 20, as shown in FIG. 6. The tube 1 is made of non-magnetic material. An ion beam passage, through which ion beam 2 runs, extends in an interior of the tube 10, which is kept at a vacuum. In this case, even though a space between the magnetic poles is, for example, 10 mm, an effective width in the analyzer tube 1 or the ion beam passage can not exceed 7 mm. It is, therefore, impossible to obtain a sufficient effective width of the ion beam passage.

It has been known that as shown in FIG. 7, the magnetic poles 20, 20 are integrally welded to the tube 10 to form the analyzer tube 1. The magnetic pole 20 projects into an interior of the tube 10, and then the space between the magnetic poles 20, 20 can be used as a part of the ion beam passage. In this construction, strain due to welding operation may be generated in the analyzer tube 1. Further, the analyzer tube 1 requires a complicated assembly operation because of the difficulty in welding magnetic material to non-magnetic material, and it is difficult to clean inner surfaces of the analyzer tube 1 because the magnetic poles are rigidly welded to the tube 10.

To avoid this, it has been proposed that the tube 10 is provided on opposite sides thereof with windows 11, 11 and then the magnetic poles 20, 20 are mounted onto the tube 10 through O-rings 23 so as to cover the windows 11, 11, as shown in FIG. 8. However, in this case, it is not possible to obtain a sufficient effective width of the ion beam passage as compared with the prior construction shown in FIG. 7.

The arrangement shown in FIG. 8 is effected without taking the generation of ion noise into consideration, which is generated in that the ion beam running within the ion beam passage collides against the inner wall surfaces of the analyzer tube and scatters.

Further, the space between the inner wall surfaces of the tube 10 must be smaller than that of the magnetic poles 20, so that the exhaust conductance is poor. Accordingly, the ions running within the ion beam passage may collide against the residual gas and then become neutralized.

OBJECT AND SUMMARY OF THE INVENTION

Accordingly, an object of the present invention is to provide an analyzer tube which is capable of preventing the ion noise from being generated and in which the exhaust conductance is improved.

To this end, according to one aspect of the present invention, there is provided an analyzer tube which comprises a body tube having a central axis, along which an accelerated ion beam runs and a part of which central axis extends along an arc; a pair of windows provided in the respective opposite side walls of the body tube, the windows facing to each other; and a pair of magnetic poles, each provided on the respective windows to cover it, each of magnetic poles projecting at one end portion thereof into an interior of the body tube through the respective windows, the projecting end portion being so tapered that not only a cross sectional shape along the central axis, but also a cross sectional shape along any direction perpendicular to the central axis presents an inverted trapezoid.

According to other aspects of the present invention, there is provided an analyzer tube which comprises a body tube having a central axis, along which an accelerated ion beam runs and a part of which central axis extends along an arc; a pair of windows provided in the respective opposite side walls of the body tube, the windows facing each other; and a pair of magnetic poles, each provided on the respective windows to cover it, each of magnetic poles projecting at one end portion thereof into an interior of the body tube through the respective windows, the projecting end portion being so tapered that not only a cross sectional shape along the central axis, but also a cross sectional shape along any direction perpendicular to the central axis presents an inverted trapezoid, and the projecting end portion being provided at opposite sides thereof with ridges extending parallel to the central axis.

Further, according to another aspect of the present invention, there is also provided an analyzer tube which comprises a body tube having a central axis, along which an accelerated ion beam runs and a part of which central axis extends along an arc; a pair of windows provided in the respective opposite side walls of the body tube, the windows facing to each other; a pair of magnetic poles, each provided on the respective window to cover it, each of magnetic poles projecting at one end portion thereof into an interior of the body tube through the respective windows, the projecting end portion being so tapered that not only a cross sectional shape along the central axis, but also a cross sectional shape along any direction perpendicular to the central axis presents an inverted trapezoid, and the projecting end portion being provided at opposite sides thereof with ridges extending parallel to the central axis; and a pair of baffle plates provided adjacent to opposite inner side wall surfaces of a portion of the body tube which corresponds to the magnetic poles, each of the baffle plates having an angled cross sectional shape, both of baffle plates being so disposed that ridges thereof project inwardly and extend parallel to the central axis.

In the present invention, since the magnetic pole has a projecting end portion having an inverted trapezoid cross section, additional spaces are formed at opposite inner sides of the body tube, whereby improving an exhaust conductance. Accordingly, it can be possible to remove the disadvantage that the running ion collides against the residual gas and then is neutralized.

Further, according to the present invention, even though the running ion beam is deflected, such ion beam does not collide against the inner wall surfaces of the analyzer tube, but does collide against the baffle plates so that the ion beam is prevented from returning back to the ion beam passage, thereby consuming energy in the tapered portion. Accordingly, such ion beam does not behave to generate ion noise.

Further, in the present invention, since the seam construction formed by the ridges provided in the side edge portion of the magnetic pole, it, therefore, becomes possible to widen a radial region along the magnetic pole in which the intensity of magnetic flux density is uniform. Accordingly, the ion beam is considerably prevented from scattering and colliding against the inner wall surface of the analyzer tube. Therefore, the generation of ion noise is substantially suppressed by the combination of the baffle plate and the seam construction.

Figure 1A:
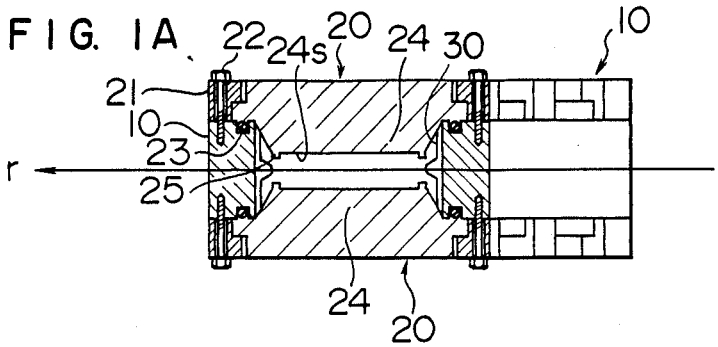
FIG. 1A is a sectional view taken along the lines 1A—1A in FIG. 1C.

An end portion 24 of the magnetic pole 20 projects into an interior of the tube 10 through the window 11 thereof. The projecting portion 24 is so tapered that not only a cross sectional shape along the central axis Z of the analyzer tube 1, but also a cross sectional shape along any axis perpendicular to the central axis Z presents an inverted trapezoid. The portion 24 of the magnetic pole 20 projects into the interior of the tube 10 so that a projecting end surface 24*s* of the portion 24 extends in the same plane as an inner wall surface 10*s* of the tube 10 extends (FIG. 1B). Accordingly, a width of an ion beam passage in a portion of the analyzer tube 1 in which there are magnetic poles 20, 20 becomes identical to that in a portion of the analyzer tube 1 in which there is no magnetic pole 20.

Figure 1B:
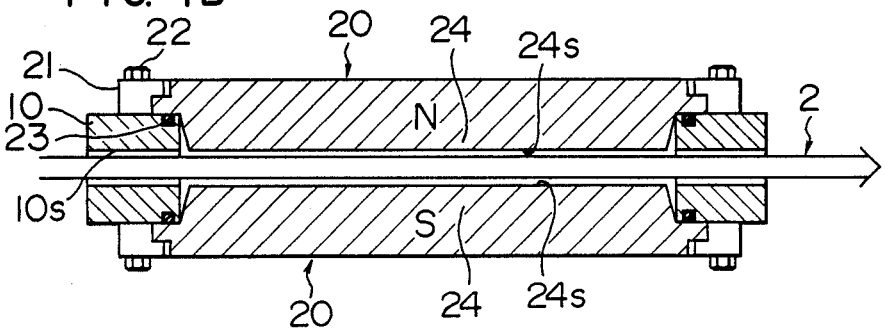
FIG. 1B is a sectional view taken along the lines 1B—1B in FIG. 1C.
Figure 1C:
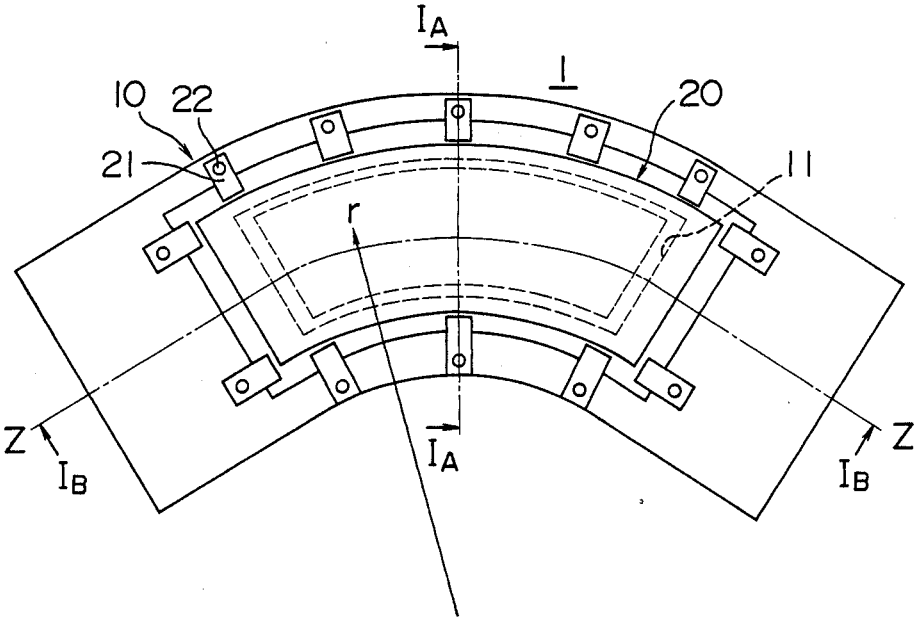
FIG. 1C is a top view showing an analyzer tube according to one embodiment of the present invention.
Figure 1D:
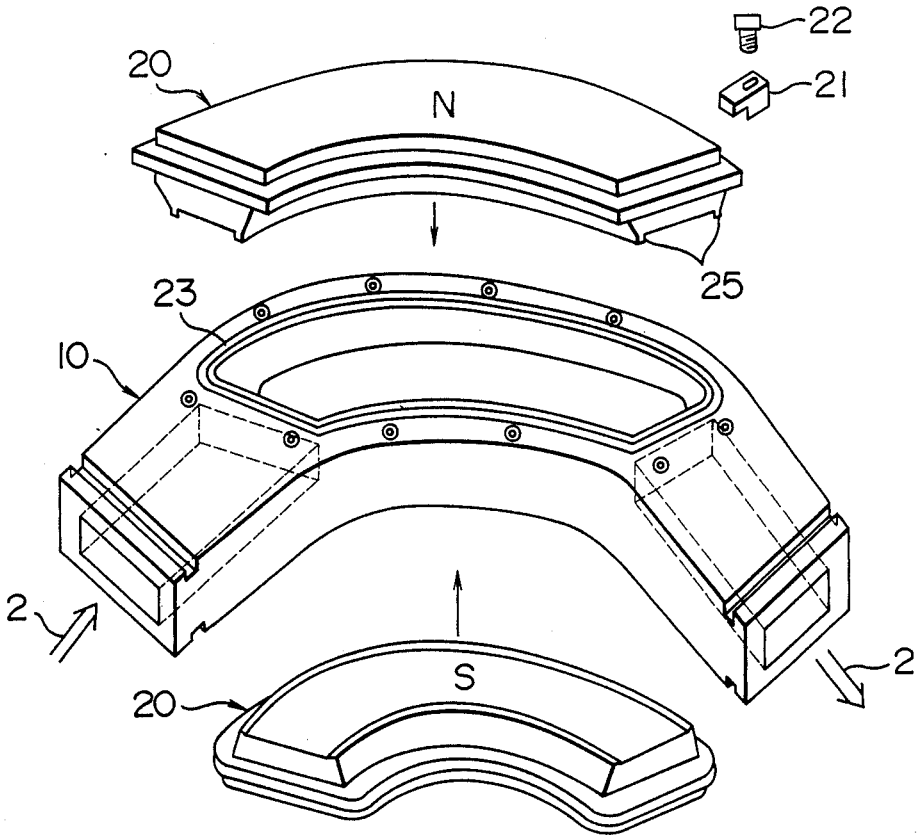
FIG. 1D is a perspective view showing the analyzer tube shown in FIG. 1C.

As clearly shown in FIG. 1A, the magnetic pole 20 is provided with ridges 25, 25 which form a seam construction. The edges of the projecting portion 24 extend parallel to the central axis Z. The height of ridge 25 corresponds to 5% of the width between the opposite projecting end surfaces 24*s* and 24*s*.

Figure 2A:
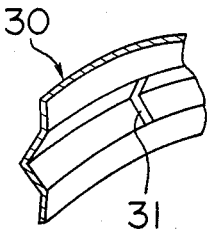
FIG. 2A is a fragmentary perspective view showing the baffle plate shown in FIG. 1A.
Figure 2B:
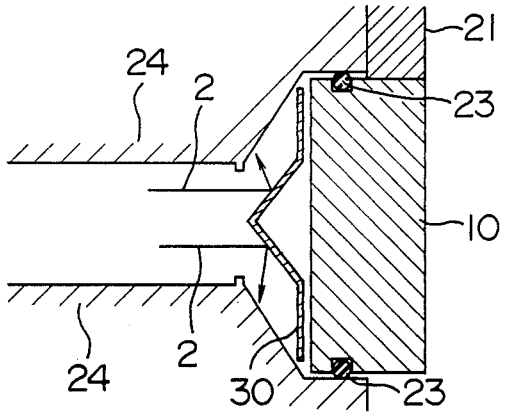
FIG. 2B is a fragmentary sectional view showing the baffle plate shown in FIG. 1A.

Further, as shown in FIG. 1A, the tube 10 is provided at the respective inner wall surface portions thereof corresponding to the magnetic poles 20, 20 with a metal baffle plate 30 which has an angled cross sectional shape. The baffle plate 30 is so disposed that a ridge thereof extends along the central axis Z. As shown in FIG. 2A, the baffle plate 30 is provided at the angled portion thereof with slots 31 which extend in a direction perpendicular to the central axis Z, so that the baffle plate 30 is readily curved to correspond to the arcuate part of the analyzer tube 1. The baffle plate 30, as shown in FIG. 2B, reflects unnecessary ion beams 2 deflected by magnetic field caused by the magnetic poles 20, 20, so that the unnecessary ion beams 2 is prevented from returning back to the ion beam passage between the magnetic poles 20, 20.

Figure 3:
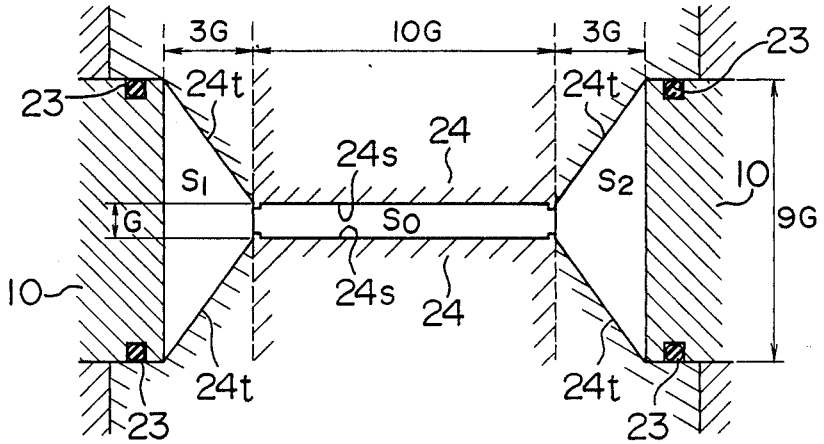
FIG. 3 is a sectional view showing the relationship between the exhaust conductance in the prior art and that in the present invention.

According to the present invention, the magnetic poles 20, 20 are so disposed opposite to each other as to place the ion beam passage between them. Further, the projecting portion 24 presents the inverted trapezoid cross sectional shape in the central axis Z direction as well as in the direction perpendicular to the central axis Z direction. Accordingly, as shown in FIG. 3, additional spaces S1, S2 are formed at opposite inner sides of a part of the tube 1 in which the magnetic poles 20, 20 are located. These additional spaces S1, S2 can improve the exhaust conductance. In FIG. 3, as compared with the prior art magnetic poles which indicated by the broken line, large additional spaces S1, S2 are provided between the tapered portions 24*t*, 24*t* of the magnetic poles 20, 20. In this embodiment, assuming that an axial width between the projecting end surfaces 24*s*, 24*s* of the magnetic poles 20, 20 is G, a radial width of the projecting end surface 24*s* is ten (10) times of G, a radial width of the tapered portion 24*t* at each sides is three (3) times of G, and an axial width of the inner wall of the tube 1 is nine (9) times of G, the exhaust conductance Cpa according to the prior art and the exhaust conductance Cpr according to the above embodiment are represented by the following equations, respectively.

$$Cpa = S_0 = 10G \times G = 10G^2$$

$$\begin{aligned} Cpr &= S_0 + S_1 + S_2 \\ &= 10G^2 + (G + 9G) \times 3G/2 + (G + 9G) \times 3G/2 \\ &= 10G^2 + 15G^2 + 15G^2 = 40G^2 \end{aligned}$$

$$\therefore Cpr/Cpa = 40G^2/10G^2 = 4$$

As apparent from the above mentioned equations, the exhaust conductance according the above embodiment is a level four (4) times higher than that of the prior art.

Figure 4:
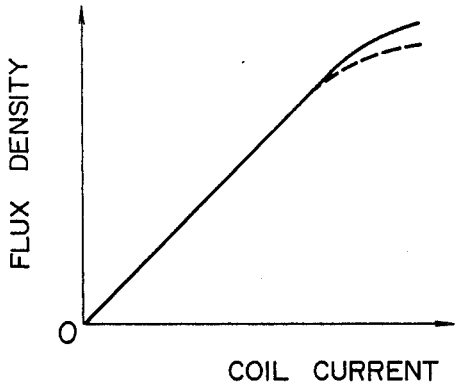
FIG. 4 is a graph showing the relationship between the flux density and the coil current.

Further, in the present invention, the projecting portion 24 of the magnetic pole 20 is tapered, so that the saturation characteristics of flux density is improved, which is shown in a solid line in FIG. 4, as compared with that of the magnetic pole without the tapered projecting part which is shown in broken line in FIG. 4.

In the present invention, the baffle plate is disposed adjacent to the inner walls of the analyzer tube so that the ridge thereof extends parallel to the central axis Z and projects inwardly. Accordingly, even if the ion beam running within the ion beam passage between the magnetic poles collides against the inner wall surfaces of the analyzer tube, such ion beam is reflected by the baffle plates to the tapered portion, not into the ion beam passage, thereby consuming energy in the tapered portion. Therefore, such ion beam does not generate ion noise.

Figure 5:
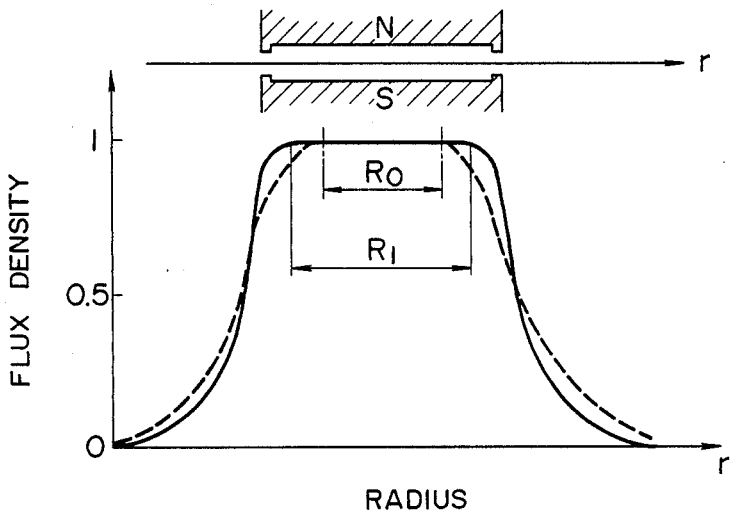
FIG. 5 is a graph showing the relationship between the flux density and the radius.
Figure 6:
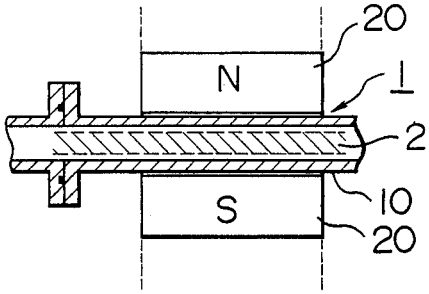
FIG. 6 PRIOR ART
FIGS. 6 to 8 are sectional views showing the prior arts, respectively. cl DETAILED DESCRIPTION OF THE PREFERRED EMBODIMENTS Referring to FIGS. 1A to 1D, the analyzer tube 1 for mass spectrometry according to one embodiment of the present invention is so curved that a part of a central axis (Z-axis) thereof extends along an arc. The analyzer tube 1 includes a tube 10 having a rectangular cross section, which is made of non-magnetic material. The opposite wall portions of the tube 10 are provided at the curved portions thereof with windows 11, 11, respectively. The analyzer tube 1 also includes a pair of magnetic poles 20, 20 disposed opposite to each other so as to cover the respective windows 11, 11. Each of the magnetic poles 20 is mounted onto the tube 10 through a periphery of the magnetic pole 20. The magnetic pole 20 is secured to the tube 10 by means of pressing the periphery of the magnetic pole 20 through a plurality of pressure plates 21 each of which is screw-mounted on the tube 10 by a screw 22. An O-ring 23 is interposed between the periphery of the magnetic pole 20 and the tube 10.
Figure 7:
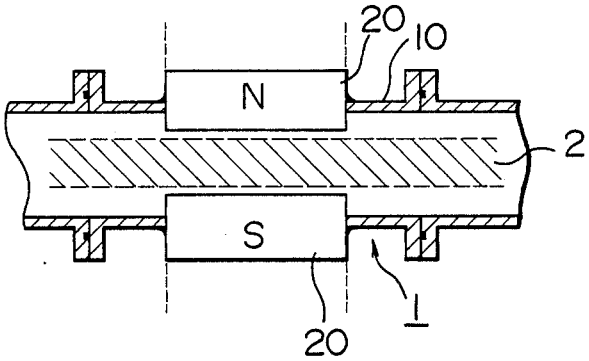
FIG. 7 PRIOR ART
Figure 8:
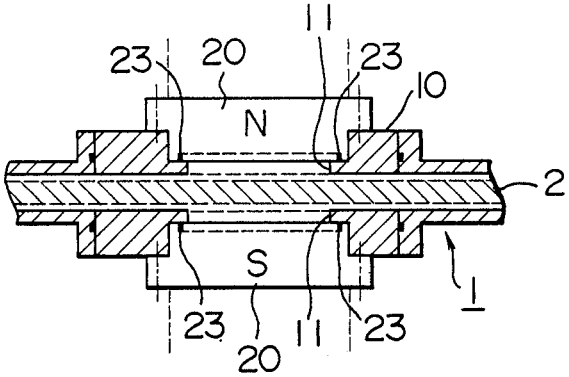
FIG. 8 PRIOR ART

Further, in the present invention, since the seam construction formed by the projections is provided in the edge portion of the magnetic pole, it, therefore, becomes possible to widen a radial region along the magnetic pole in which the intensity of magnetic flux density is uniform. As shown in FIG. 5, the uniform flux density region R1 (solid line) according to the present invention is wider than that R0 (broken line) of the prior art. According this, the ion beam is considerably prevented from scattering and colliding against the inner wall surface of the analyzer tube. Therefore, the generation of ion noise is substantially suppressed by the combination of the baffle plate and the seam construction.

What is claimed is:

1. An analyzer tube for mass spectrometry comprising:

a body tube having a central axis, along which an accelerated ion beam runs and a part of which extends along an arc;

a pair of windows provided in the respective opposite side walls of said body tube, said windows facing each other; and a pair of magnetic poles, each provided on a respective one of said windows to cover it, each of said magnetic poles projecting at one end portion thereof into an interior of said body tube though the respective one of said windows, the projecting end portion being so tapered that not only a cross sectional shape along said central axis, but also a cross-sectional shape along any direction perpendicular to said central axis presents an inverted trapezoid;

wherein said analyzer tube has a configuration which enables an increase in exhaust conductance while substantially preventing generation of ion noise; and wherein said projecting end portions are provided at opposite side edge portions thereof with ridges extending parallel to said central axis.

2. An analyzer tube for mass spectrometry comprising:

a body tube having a central axis, along which an accelerated ion beam runs and a part of which extends along an arc;

a pair of windows provided in the respective opposite side walls of said body tube, said windows facing each other; and a pair of magnetic poles, each provided on a respective one of said windows to cover it, each of said magnetic poles projecting at one end portion thereof into an interior of said body tube though the respective one of said windows, the projecting end portion being so tapered that not only a cross sectional shape along said central axis, but also a cross-sectional shape along any direction perpendicular to said central axis presents an inverted trapezoid;

wherein said analyzer tube has a configuration which enables an increase in exhaust conductance while substantially preventing generation of ion noise; and wherein said analyzer tube further comprises a pair of baffle plates provided adjacent to opposite inner side wall surfaces of a portion of said body tube which corresponds to said magnetic poles, each of said baffle plates having an angled cross sectional shape, said baffle plates being so disposed that ridges thereof project inwardly and extend parallel to said central axis.

3. An analyzer tube for mass spectrometry comprising:

a body tube having a central axis, along which an accelerated ion beam runs and a part of which extends along an arc;

a pair of windows provided in the respective opposite side walls of said body tube, said windows facing each other; and a pair of magnetic poles, each provided on a respective one of said windows to cover it, each of said magnetic poles projecting at one end portion thereof into an interior of said body tube though the respective one of said windows, the projecting end portion being so tapered that not only a cross sectional shape along said central axis, but also a cross-sectional shape along any direction perpendicular to said central axis presents an inverted trapezoid;

wherein said analyzer tube has a configuration which enables an increase in exhaust conductance while substantially preventing generation of ion noise; and wherein said projecting end portions are provided at opposite sides thereof with ridges extending parallel to said central axis, and wherein said analyzer tube further comprises a pair of baffle plates provided adjacent to opposite inner side wall surfaces of a portion of said body tube which corresponds to said magnetic poles, each of said baffle plates having an angled cross sectional shape, said baffle plates being so disposed that ridges thereof project inwardly and extend parallel to said central axis.

4. An analyzer tube according to claim 3, wherein said magnetic poles are mounted onto said body tube through O-rings and are secured onto said body tube by means of clamping means.

* * * * *